US010383180B2

(12) United States Patent
Perricone

(10) Patent No.: US 10,383,180 B2
(45) Date of Patent: Aug. 13, 2019

(54) INDUCTOR DEVICE, IN PARTICULAR FOR HARDENING ROLLING TRACKS OF AN OUTER RING OF A VEHICLE HUB BEARING UNIT

(71) Applicant: Marco Perricone, Pinerolo (IT)

(72) Inventor: Marco Perricone, Pinerolo (IT)

(73) Assignee: Aktiebolaget SKF, Göteborg (SE)

( * ) Notice: Subject to any disclaimer, the term of this patent is extended or adjusted under 35 U.S.C. 154(b) by 691 days.

(21) Appl. No.: 14/719,375

(22) Filed: May 22, 2015

(65) Prior Publication Data

US 2015/0351162 A1 Dec. 3, 2015

(30) Foreign Application Priority Data

May 27, 2014 (IT) ..... TO2014A0417

(51) Int. Cl.

| | |
|---|---|
| ***H05B 6/10*** | (2006.01) |
| ***H05B 6/04*** | (2006.01) |
| ***H05B 6/06*** | (2006.01) |
| ***H05B 6/14*** | (2006.01) |
| ***H05B 6/36*** | (2006.01) |
| ***H05B 6/38*** | (2006.01) |
| ***H05B 6/42*** | (2006.01) |

(52) U.S. Cl.

CPC ..... *H05B 6/10* (2013.01); *H05B 6/04* (2013.01); *H05B 6/06* (2013.01); *H05B 6/14* (2013.01); *H05B 6/36* (2013.01); *H05B 6/38* (2013.01); *H05B 6/42* (2013.01)

(58) Field of Classification Search

CPC ... H05B 6/10; H05B 6/36; H05B 6/06; H05B 6/42; H05B 6/14; H05B 6/38; H05B 6/04

USPC ..... 219/642, 609, 639, 673, 677, 635, 637, 219/640, 643, 672; 29/602.1, 607, 825

See application file for complete search history.

(56) References Cited

U.S. PATENT DOCUMENTS 5,451,749 A * 9/1995 Griebel ..... H05B 6/101 148/572

5,680,693 A 10/1997 Griebel et al.

(Continued)

FOREIGN PATENT DOCUMENTS

CN 2506049 Y 8/2002

CN 2521864 Y * 11/2002

(Continued)

*Primary Examiner* — Dana Ross

*Assistant Examiner* — Joseph M Baillargeon

(74) *Attorney, Agent, or Firm* — Bryan Peckjian; SKF USA Inc. Patent Dept.

(57) ABSTRACT

An inductor device, including: blocks of electrically conducting material which are electrically isolated from each other, a block of electrically insulating material supporting respective induction coils, an integrated shower and a hydraulic circuit partly obtained within the blocks of electrical conducting material and including: a first branch for feeding a cooling fluid to the induction coils which hydraulically connects all the induction coils in parallel and mechanically in sequence to each other. A second branch hydraulically connects only a first induction coil with a first return outlet of the hydraulic circuit. A third branch for each induction coil in addition to the first, each third branch including a second return outlet separated from the first outlet and being hydraulically connected with only one single induction coil other than the first.

9 Claims, 6 Drawing Sheets

(56) References Cited

U.S. PATENT DOCUMENTS

| | | | | |
|---|---|---|---|---|
| 2008/0277386 | A1* | 11/2008 | Haimer | B23P 11/027 219/644 |
| 2012/0217235 | A1* | 8/2012 | Mathai | B05B 13/0436 219/600 |
| 2013/0140299 | A1 | 6/2013 | Kiyosawa et al. | |

FOREIGN PATENT DOCUMENTS

| | | | |
|---|---|---|---|
| CN | 1403599 | A | 3/2003 |
| CN | 101478842 | A | 7/2009 |
| CN | 201336741 | Y | 10/2009 |
| CN | 201751033 | U | 2/2011 |
| CN | 101993992 | A | 3/2011 |
| CN | 202039091 | U | 11/2011 |
| DE | 2938793 | A1 | 4/1981 |

* cited by examiner

INDUCTOR DEVICE, IN PARTICULAR FOR HARDENING ROLLING TRACKS OF AN OUTER RING OF A VEHICLE HUB BEARING UNIT

CROSS REFERENCE TO RELATED APPLICATIONS

This is a Non-Provisional Patent Application, filed under the Paris Convention, claims the benefit of Italy Patent (IT) Application Number TO2014A000417 filed on 27 May 2014 (27 May 2014), which is incorporated herein by reference in its entirety.

TECHNICAL FIELD OF THE INVENTION

The present invention relates to an inductor device for carrying out a heat hardening treatment on tracks of a rolling bearing.

TECHNICAL BACKGROUND

In rolling bearings, the sliding tracks of the rolling elements must be hardened. In bearings with a double row of rolling elements, in particular with a double row of balls used in vehicle hub bearing units, induction hardening of the rolling tracks of the outer ring of the bearing is a particularly delicate operation. In fact, the presence of sharp edges between the two adjacent tracks implies risk of over-heating and cracking; on the other hand, if the heating power is decreased to avoid these risks, there is the risk of not achieving a hardening profile that is suitable in depth, extension or surface hardness of the hardened area.

Moreover, the induction heating devices, or more simply, inductors currently used, are bulky, difficult to construct and/or maintain and sometimes with a not entirely satisfactory reliability.

SUMMARY OF THE INVENTION

The object of the present invention is to provide an inductor device that is simple and cost-effective in construction and highly reliable, while ensuring an optimal use of the thermal energy supplied by it.

According to the invention, therefore, an inductor device is provided having the features set out in the appended claims.

Thanks to the invention, the heating of adjacent tracks of the parts to be hardened is made even, the risk of overheating the adjacent sharp edges of the tracks is prevented and optimal use of the thermal energy supplied is ensured.

Moreover, the inductor device is compact, easy to manufacture, easy to maintain and completely reliable over time, thanks to an optimal cooling of the parts thereof.

BRIEF DESCRIPTION OF THE DRAWINGS

Further features and advantages of the present invention will become apparent from the following description of an exemplary non-limiting embodiment given purely by way of example with reference to the figures of the accompanying drawings, in which.

DETAILED DESCRIPTION

Figure 1:
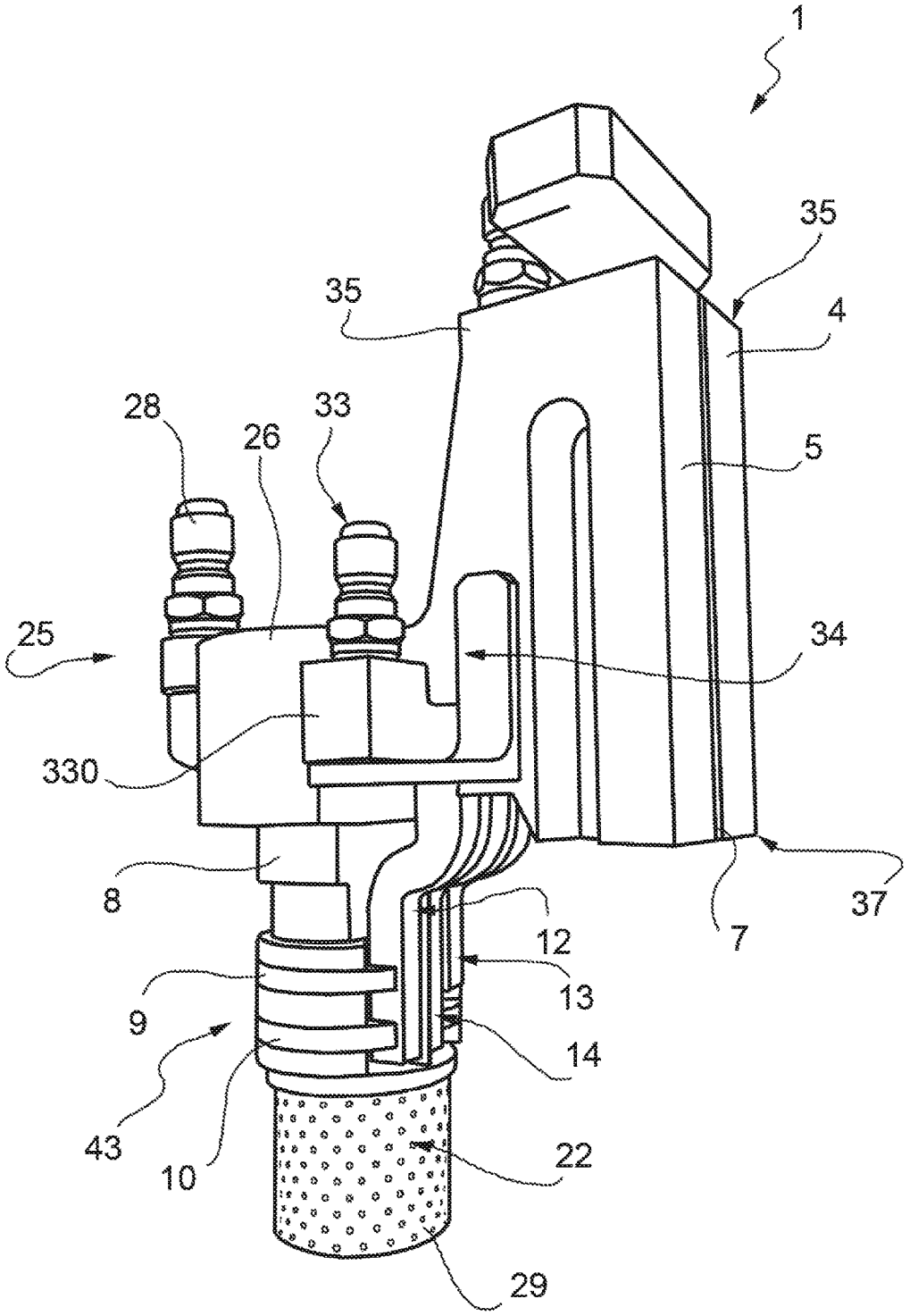
FIG. 1 shows a schematic rear three-quarters perspective view of an inductor device made according to the invention.
Figure 2:
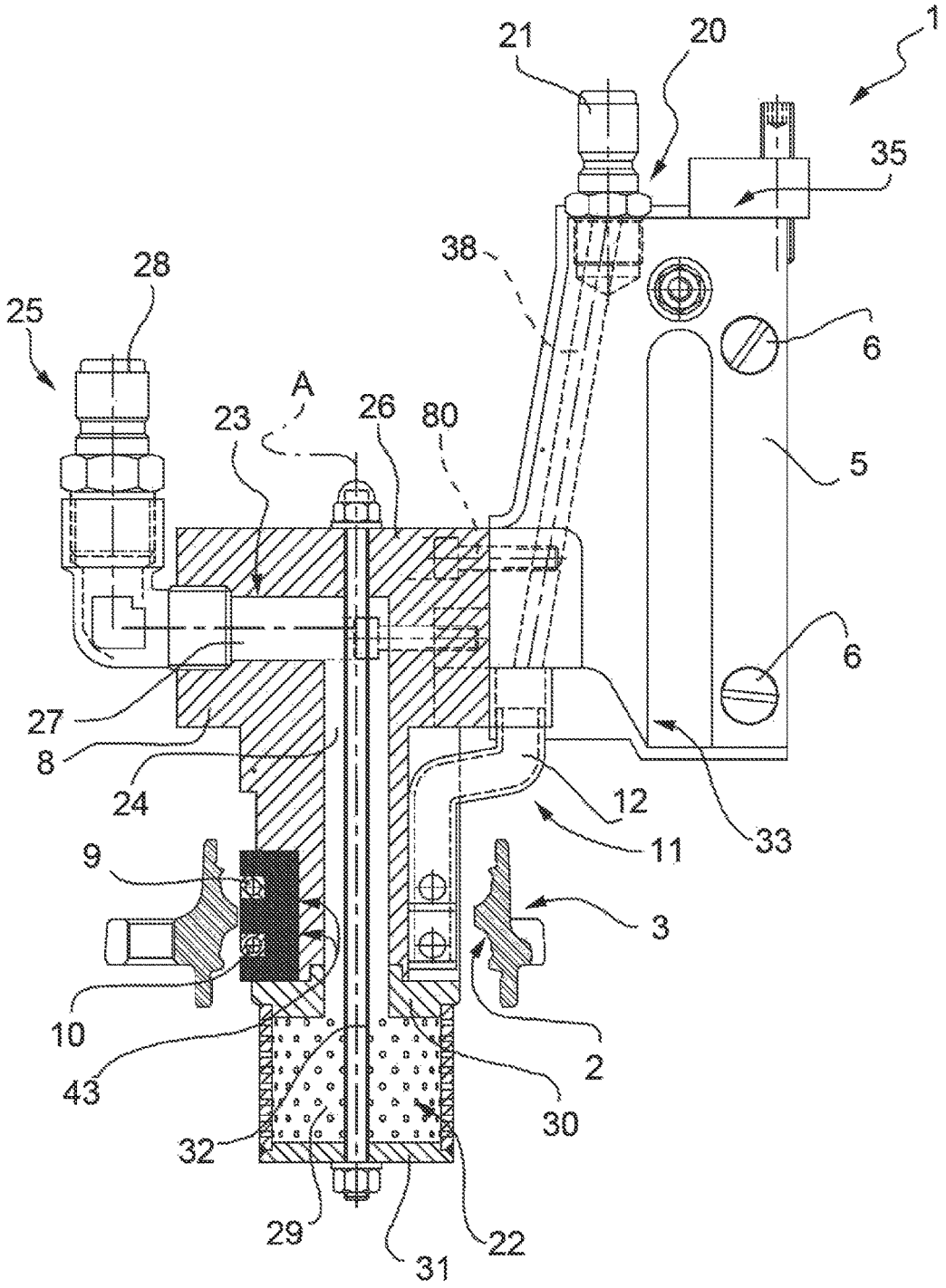
FIG. 2 shows a lateral elevation sectional view along a vertical plane, of the inductor device of the invention, shown for comparison having been positioned on a part to be hardened.

With reference to FIGS. 1 to 4, reference numeral 1 indicates as a whole an inductor device, in particular, for hardening rolling tracks 2 of an outer ring 3 of a bearing of a vehicle hub bearing unit, known and not shown for simplicity.

The inductor device 1, like the known device used for the same purpose, comprises: at least one pair of blocks 4, 5 of electrically conducting material, which blocks 4,5 are mechanically coupled to each other, in the example shown by means of transverse screws 6, and are electrically isolated, in example shown by means of a sheet 7 of insulating material; at least one block 8 of electrically insulating material, which block 8 is mechanically connected to the blocks 4, 5 of electrically conducting material, for example by means of screws 80 (FIGS. 2 and 4); and a predetermined number of induction coils, in the example shown they are two in number, a first coil 9 and a second coil 10, all supported by the block 8 of insulating material, for example made of a heat-resistant synthetic plastic material or ceramic. Coils 9 and 10 are annular and have an axis of symmetry A.

Device 1 further comprises a hydraulic circuit 11 partly obtained within the blocks of electrical conducting material 4, 5 and partly obtained by means of respective pipe stretches 12, 13, 14 made of electrical conducting material and external to the blocks of electrical conducting material 4, 5 and mechanically connected in a fluid-tight manner on one side with the blocks of electrical conducting material and on the other side with the induction coils 9, 10.

In particular, the hydraulic circuit 11 comprises (FIG. 3) at least a first branch 15 for feeding a cooling fluid, generally demineralized water, to the induction coils 9, 10 and at least a second branch 16 for removing the cooling fluid from the induction coils 9, 10.

Figure 3:
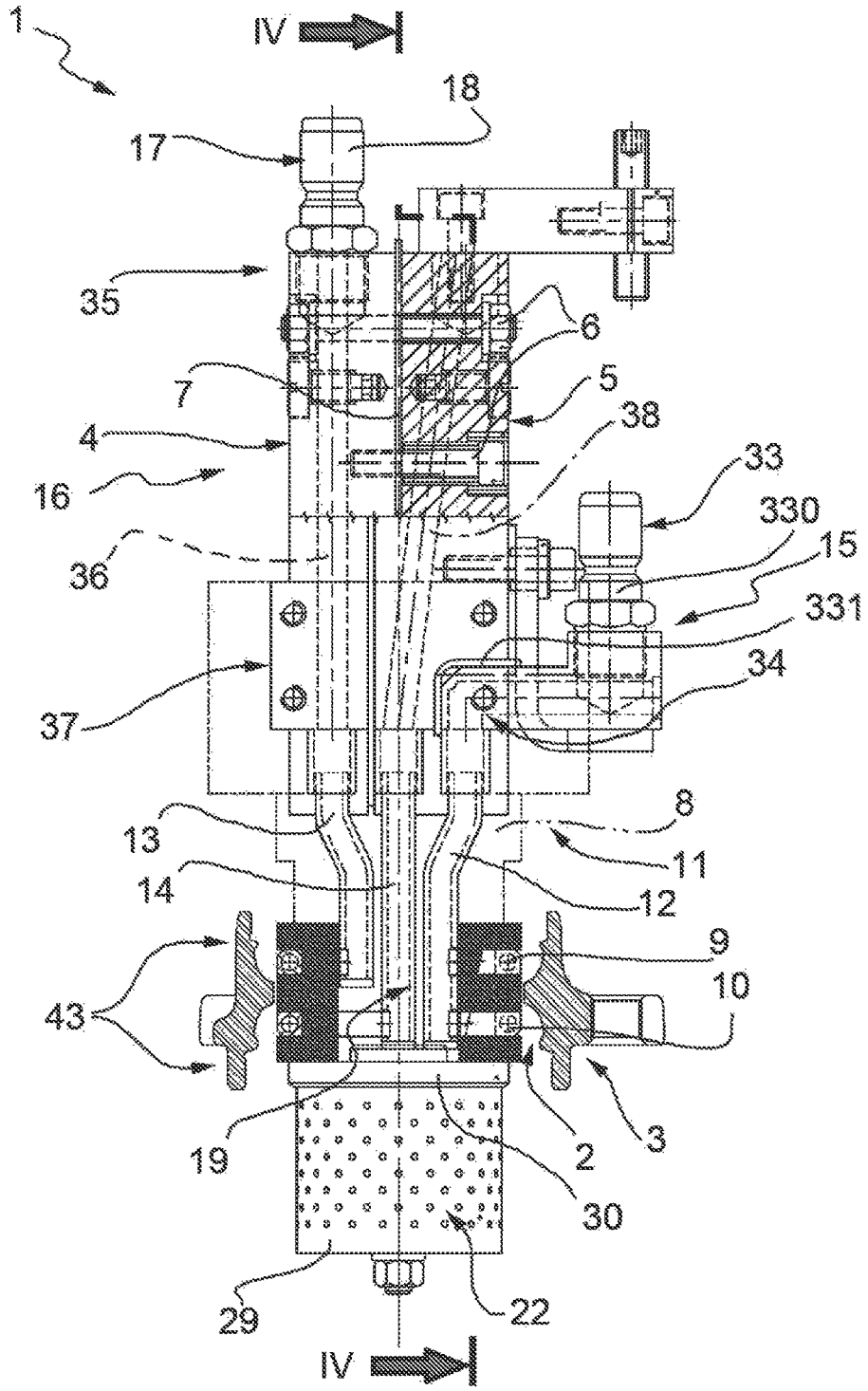
FIG. 3 shows a front partly sectional view of the inductor device in FIG. 2.
Figure 4:
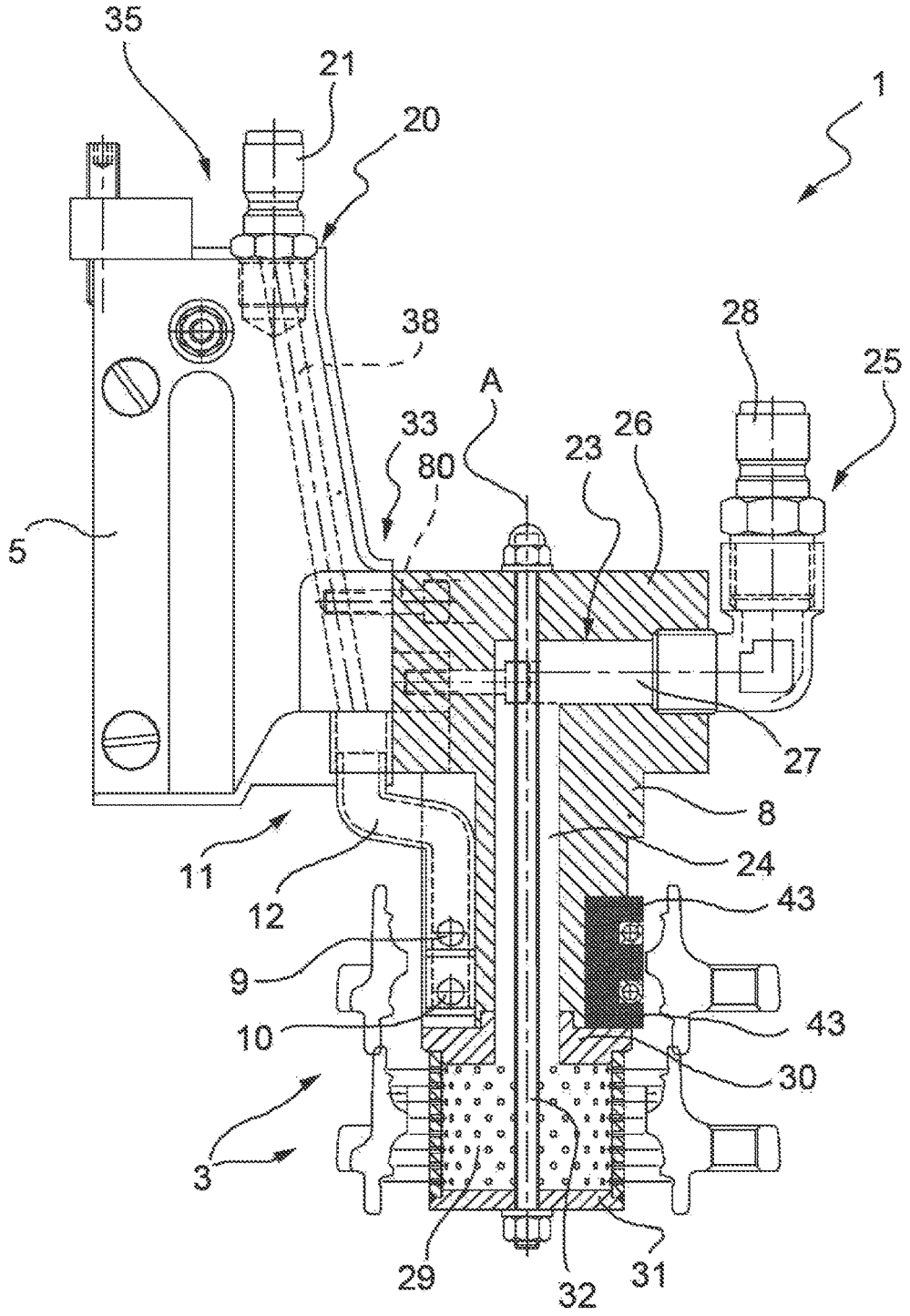
FIG. 4 shows a lateral elevation sectional view of the inductor device, the section being taken along a plane Iv-Iv shown in FIG. 3, the inductor device being shown rotated by 180° relative to the view in FIG. 2.

According to a first aspect of the invention, the first branch 15 hydraulically connects all the induction coils 9, 10 in parallel and mechanically in sequence to each other, thus in the example shown, both coils 9, 10, as is well shown in FIG. 3; the second branch 16, on the other hand, hydraulically connects only the first induction coil 9 with a first return outlet 17 of the hydraulic circuit 11 defined by a connection 18 mounted externally on the block of conducting material 4; in combination, the hydraulic circuit 11 also comprises at least a third branch 19 (FIG. 3) for each induction coil present in addition to the first coil 9; each third branch 19 comprises a second return outlet 20 of the hydraulic circuit 11, separated from the first outlet 17, and is hydraulically connected with only one single induction coil other than the first coil 9; in the example shown, there is only one third branch 19 which connects only coil 10 with the second outlet 20, which is defined by a connection 21 mounted externally on block 5 of conducting material.

According to a further and non secondary aspect of the invention, the inductor device 1 further comprises a cooling shower 22 (hardening shower) integrally carried by one of blocks 4, 5, 8 and arranged close to the induction coils 9, 10.

In particular, the cooling shower 22 is integrally carried by the block of insulating material 8 and is supplied by a second hydraulic circuit 23 (FIGS. 2 and 4) comprising a first through hole 24 obtained in an axial direction, in particular coaxial to the axis of symmetry A of coils 9, 10 through the block of electrically insulating material 8 and along the entire length thereof, and a feeding inlet 25 arranged at one end 26 of block 8 which is distal from the induction coils 9, 10 and defined by a second hole 27 obtained in a radial direction through the block of electrically insulating material 8 and by a connection 28 externally carried in overhanging manner by the distal end 26.

Shower 22 is formed, in the preferred embodiment shown, by a laterally perforated cylindrical sleeve 29 sandwiched against one end 30 of the block of electrically insulating material 8, opposite end 26 and therefore vicinal to the induction coils 9, 10, by means of a dish 31 and a stay rod 32 coaxial and through-inserted within hole 24 and axially blocked on one side against dish 31 and the opposite side against end 26.

In the preferred but not binding embodiment example, branch 15 (FIGS. 1 and 3) comprises an inlet 33 carried by a first of the blocks of electrically conducting material 4, 5, in particular by block 5 at one end 34 of block 5 vicinal to the induction coils 9, 10, and a first pipe stretch defined by stretch 12 which hydraulically connects in parallel and mechanically in sequence all the present induction coils to each other, in particular both coils 9, 10. Inlet 33 is defined, in the non-limiting example shown, by a connection 330 made of stainless steel and which is integrally fixed to block 5, laterally overhanging from the same, with the interposition of an electrically insulating element 331 (FIG. 3). Connection 330 is hydraulically connected in a direct manner with the pipe stretch 12.

The second branch 16 comprises the first return outlet 17, which is obtained on one of the blocks of electrically conducting material 4, 5, in particular on block 4, at one end 35 of blocks 4, 5, in particular of block 4, distal from the induction coils 9, 10, a first conduit consisting of a hole 36 which passes through the block of electrical conducting material 4 from the distal end 35 to an end 37, opposite to end 35, of block 4, vicinal with respect to the induction coils 9, 10, and a second pipe stretch, defined by stretch 13, which hydraulically connects the vicinal end 37 of the block of electrically conducting material 4 with only the first induction coil 9.

On the other hand, the third branch 19 has the second return outlet 20 obtained on the other of the blocks of electrically conducting material, in particular on block 5, at the distal end 35 of blocks 4, 5, in particular of block 5, and it further comprises: a second conduit consisting of a hole 38 which passes through the block of electrically conducting material 5 from the distal end 35 to its opposite vicinal end 34 with respect to the induction coils 9, 10; and a third pipe stretch 14 that hydraulically connects the vicinal end 34 of the block of electrically conducting material 5 with only one single induction coil other than the first coil 9, in particular with the single coil 10.

Figure 6:
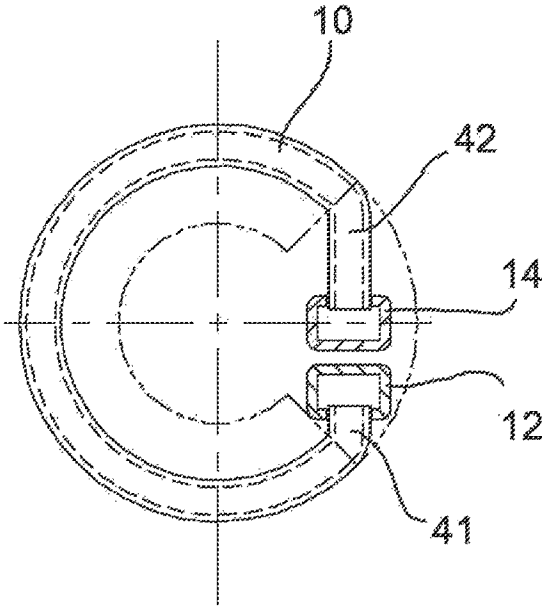
FIGS. 6 and 7 show a plan and an elevation view, respectively, and in enlarged scale, respective constructional details of the inductor device of the invention.
Figure 5:
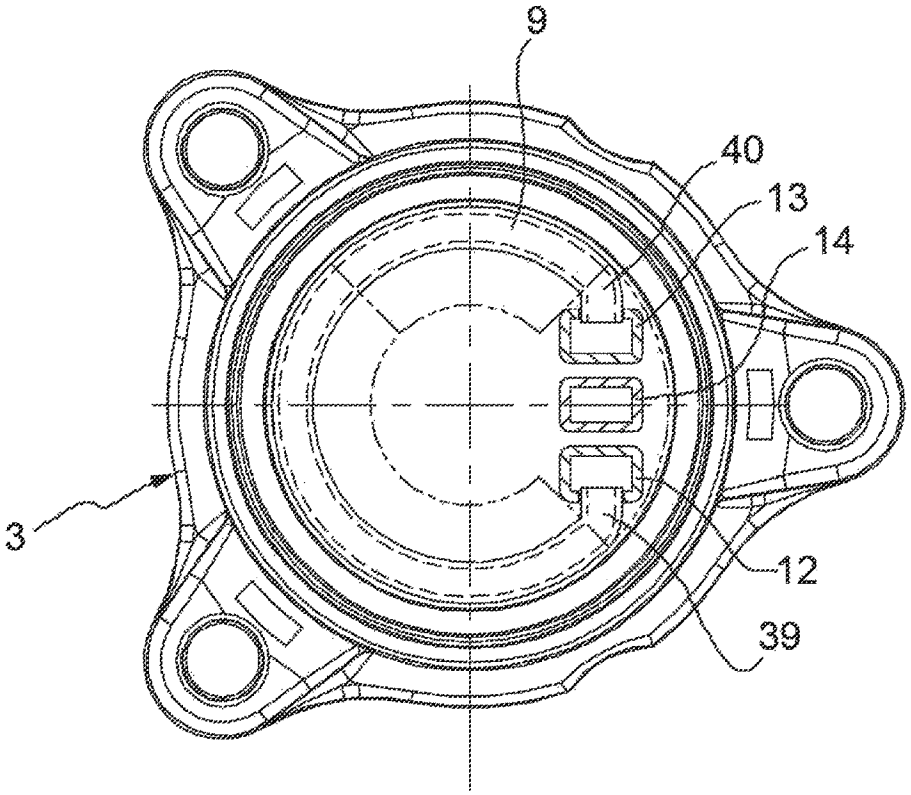
FIG. 5 shows a bottom plan view of the inductor device in FIG. 2, surrounded by a part to be hardened.

The annular induction coils 9, 10 are both arranged coaxial with axis A and have substantially the same size; the two coils 9, 10 are arranged in tandem (i.e. in axial sequence, the coil 9 nearest to blocks 4, 5 and thus interposed between blocks 4, 5 and coil 10), are axially spaced from each other and each define (FIGS. 5 and 6) a substantially annular pipe stretch ending with opposite open ends 39 and 40, coil 9, and 41, 42, coil 10.

The corresponding first ends 39 and 41 of coils 9, 10 are both connected with the first pipe stretch 12, while the corresponding second ends 40, 42 of the first coil 9 and the second coil 10, respectively, are connected with the second pipe stretch 13 and with the third pipe stretch 14, respectively; these pipe stretches 12, 13 and 14 are connected by welding to ends 39-42 on one side and are welded to blocks 4, 5 on the opposite side, so as to be hydraulically connected stretch 12 with the feeding inlet 33, stretch 13 with hole 36 and stretch 14 with hole 38.

At least the second ends 40, 42 of coils 9, 10 define rectilinear chordal portions of different lengths of the annular pipe stretches defined by coils 9, 10 themselves; in particular, the chordal end 42 is longer than the 40, so as to reach the pipe stretch 14 arranged at the center between stretches 12 and 13, side by side.

Figure 7:
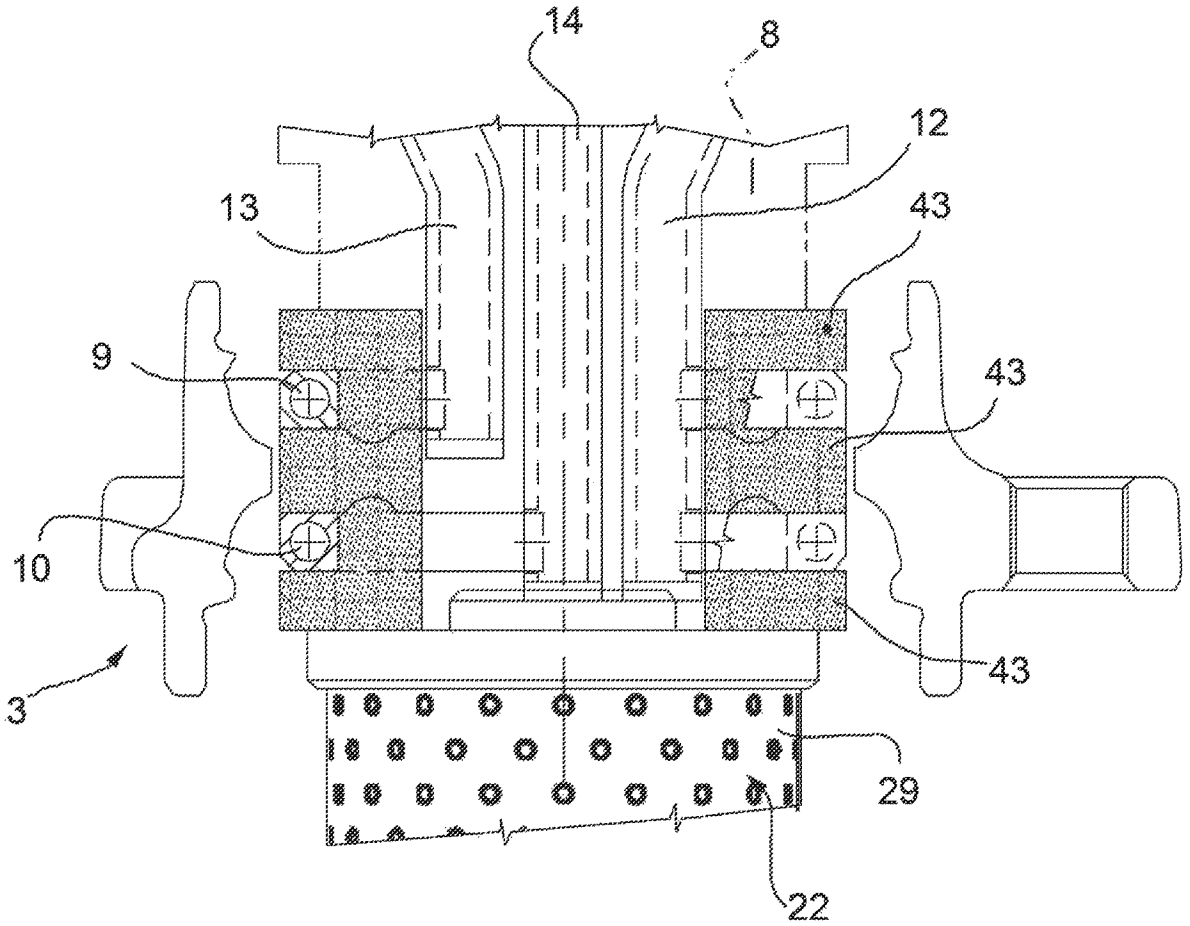

Respective flux concentrators 43 with incomplete annular development, i.e. in the shape of radially open rings, fully surrounding coils 9, 10, are arranged on the first and the second induction coil 9, 10; the flux concentrators 43 (FIG. 7) are three in number and are mounted by means of overlap joint with respect to each other in an axial direction and are supported straddling the block of electrically insulating material 8, while the pipe stretches 12, 13 and 14 are arranged in the open circumferential areas of the flux concentrators 43 and within the dimensions of shower 22, so as to obtain a compact and at the same time easy to produce and easy to maintain structure.

All the objects of the invention are thus achieved.

The invention claimed is:

1. An inductor device, for hardening rolling tracks of an outer ring of a vehicle hub bearing unit, the inductor device comprising:

at least one pair of blocks of electrically conducting material mechanically coupled to each other and electrically isolated from each other;

at least one block of electrically insulating material mechanically connected to the blocks of electrically conducting material and supporting respective induction coils;

a first hydraulic circuit comprising a block conduit portion formed as a plurality of holes passing through the blocks of electrically conducting material and a pipe stretch portion provided by respective pipe stretches made of electrically conducting material, wherein the pipe stretch portions are external to the blocks of electrically conducting material and mechanically connected in a fluid-tight manner on one end with the blocks of electrically conducting material and on the other end, the first hydraulic circuit providing flow of cooling fluid past the induction coils and providing electrical current to the induction coils;

wherein the first hydraulic circuit comprises at least a first branch for feeding a cooling fluid to the induction coils and at least a second branch for removing the cooling fluid from the induction coils, the first branch utilizing at least one hole of the plurality of holes passing through the blocks;

wherein the first branch and the second branch create an electric circuit with the induction coils, wherein, in combination:

i) the first branch hydraulically connects all the induction coils in parallel and mechanically in sequence to each other;

ii) the second branch hydraulically connects only a first induction coil of the induction coils with a first return outlet of the first hydraulic circuit; and iii) the first hydraulic circuit comprises at least a third branch for each induction coil in addition to the first induction coil, the at least a third branch comprising a second return outlet separated from the first outlet and being hydraulically connected with only one single induction coil other than the first induction coil.

2. The inductor device according to claim 1, further comprising a cooling shower integrally carried by one of the at least one block of electrically insulating material, wherein the one of the at least one blocks of electrically insulating material is arranged close to the induction coils.

3. The inductor device according to claim 2, wherein the cooling shower is integrally carried by the at least one block of electrically insulating material.

4. The inductor device according to claim 2, wherein the shower is supplied by a second hydraulic circuit comprising:

a first through hole obtained in an axial direction through the at least one block of electrically insulating material and along the entire length thereof, and a feeding inlet arranged at one end of the block, which is distal from the induction coils and defined by a second hole obtained in a radial direction through the at least one block of electrically insulating material and by a connection externally carried in an overhanging manner by the distal end.

5. The inductor device according to claim 4, wherein the shower is formed by a laterally perforated cylindrical sleeve sandwiched against one end vicinal to the induction coils of the at least one block of electrically insulating material by a dish and a stay rod through-inserted within the first hole.

6. The inductor device according to claim 1, wherein:

i) the first branch further comprising an inlet carried by a first of the blocks of electrically conducting material at one end of the first block vicinal to the induction coils, and a first pipe stretch which hydraulically connects in parallel and mechanically in sequence all the present induction coils to each other;

ii) the second branch comprises the first return outlet, which is obtained on one of the blocks of electrically conducting material at one end of the blocks distal from the induction coils, a first conduit consisting of a hole which passes through the block of electrically conducting material from the distal end to a vicinal end with respect to the induction coils, and a second pipe stretch which hydraulically connects the vicinal end of the first of the blocks of electrically conducting material with only the first induction coil;

iii) the third branch having the second return outlet in an unoccupied electrically conductive block of the blocks of electrically conductive material and further comprising a second conduit consisting of a hole which passes through the first of the blocks of electrically conducting material from the distal end to a vicinal end with respect to the induction coils, and a third pipe stretch that hydraulically connects the vicinal end of the first of the blocks of electrically conducting material with only one single induction coil other than the first induction coil.

7. The inductor device according to claim 6, wherein the induction coils are annular and are coaxially arranged to each other.

8. The inductor device according to claim 5, wherein a size of the first induction coil and a size of a second induction coil of the induction coils are substantially the same, wherein the first induction coil and the second induction coil are arranged in tandem and each of the first induction coil and the second induction coil define a substantially annular pipe stretch terminating with opposite open ends, corresponding first ends of the first induction coil and the second induction coil being both connected with the first pipe stretch, and corresponding second ends of the first induction coil and second induction coil being connected with the second pipe stretch and the third pipe stretch respectively, the second ends of the first induction coil and the second induction coil defining straight chordal portions having different length of the annular pipe stretches defined by the induction coils.

9. The inductor device according to claim 8, further comprising respective flux concentrators with incomplete annular development fully surrounding the induction coils, wherein the flux concentrators are arranged on the first induction coil and the second induction coil; the flux concentrators being mounted by an overlap joint with respect to each other in an axial direction and being supported straddling the at least one block of electrically insulating material.

* * * * *